United States Patent [19]

Bouplon

[11] 4,329,077

[45] May 11, 1982

[54] UNDERGROUND PIPE PUSHER

[75] Inventor: Edward J. Bouplon, Streetsboro, Ohio

[73] Assignee: Allied Steel & Tractor Products, Inc., Solon, Ohio

[21] Appl. No.: 196,867

[22] Filed: Oct. 14, 1980

[51] Int. Cl.[3] ..... B25G 3/00; F16D 1/00; F16G 11/00

[52] U.S. Cl. ..... 403/287; 403/374

[58] Field of Search ..... 403/287, 309, 310, 274, 403/11, 14, 12, 369

[56] References Cited

U.S. PATENT DOCUMENTS

| | | | |
|---|---|---|---|
| 2,890,020 | 6/1959 | Hawthorne et al. | 403/374 X |
| 3,009,747 | 11/1961 | Pitzer | 403/374 X |
| 3,220,074 | 11/1965 | Ehmann | 403/374 X |
| 3,390,897 | 7/1968 | Moore | 403/287 X |
| 3,762,027 | 10/1973 | Burtelson | 403/374 UX |
| 3,952,377 | 4/1976 | Morell | 403/374 UX |

*Primary Examiner*—Wayne L. Shedd

*Attorney, Agent, or Firm*—Stephen J. Rudy

[57] ABSTRACT

An adaptor for use in driving a pipe into the ground by a ground piercing tool, which adaptor is arranged to be driven by the piercing tool. The adaptor consists of a three piece cylindrical unit held together by two garter springs. A tapered conical bore, formed in the adaptor, has a slope comparable with the slope formed on the forward end of a ground piercing tool used therewith. A portion of the adaptor is arranged to enter the end region of a pipe being worked upon, and a circumferential shoulder is formed on the adaptor, for engagement with the end of the pipe. Impact action upon the piercing tool not only wedges the adaptor into tight engagement with the inner region of the pipe, but also results in driving action upon the pipe by reason of the circumferential shoulder being in engagement with the pipe end. When the piercing tool is subjected to reverse impact action, it is released from the adaptor, and the latter is collapsed by action of the garter springs, so that it can be withdrawn from engagement with the pipe.

7 Claims, 5 Drawing Figures

FIG. 1
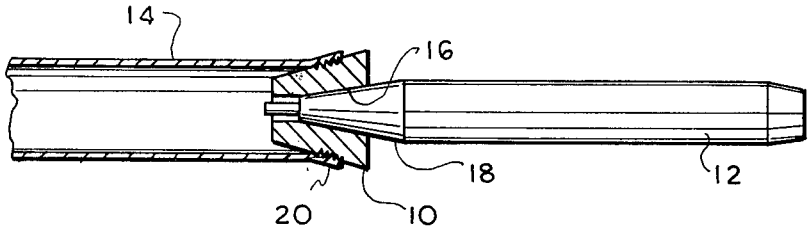
FIG. 2
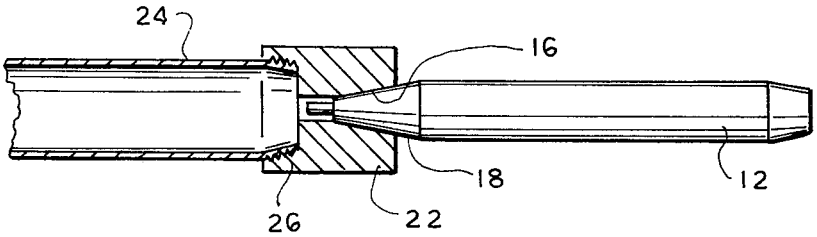
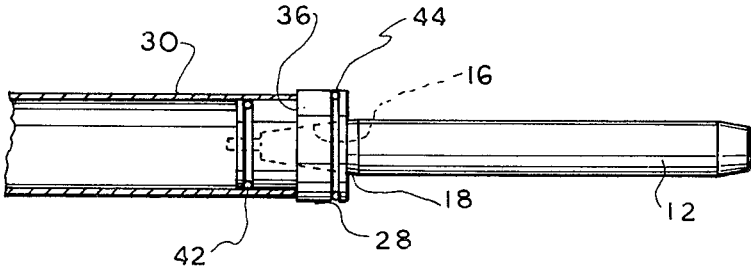
FIG. 3

UNDERGROUND PIPE PUSHER

BACKGROUND OF THE INVENTION

This invention relates to an underground pipe pusher for forcing pipe into the ground by a piercing tool.

It has been found that underground piercing tools, such for example, as disclosed in U.S. Pat. No. 3,410,354, issued on Nov. 12, 1968, can be fitted with an adaptor arranged to engage the end of a pipe whereby impacting action upon the piercing tool will drive the pipe forward into the ground. Such a method can provide economic gains over conventional ground boring machines in the matter of initial equipment cost, set-up time, and overall pipe installation time.

Such adaptors, as presently used, are formed with an internal tapered bore to match the taper of the piercing tool head end, and an external tapered surface to wedge into the end of the pipe to be pushed. Such wedging arrangement is required so that the pipe, adaptor and piercing tool are coupled together as a unit to withstand the percussive action and reaction to which the piercing tool is subjected during pipe driving action.

The inherent disadvantage of the current arrangement above described, is that the end of the pipe being driven is flared out by the adaptor, often necessitating cut-off if additional pipe is to be driven thereagainst.

In situations where the driven pipe has an exterior threaded end surface, the adaptor will have a threaded portion for connection to the pipe. Impacting action on the adaptor can damage the pipe threads, thus making connection with an adjoining pipe less effective, or even impossible if thread damage on the driven pipe is excessive.

Also, at times, the pipe adaptor, and piercing tool are wedged together so tight that time consuming effort is required for separation thereof.

The present invention, while having all the advantages of the adaptors in use as explained above, avoids the functional shortcomings thereof. For example, the adaptor disclosed herein, will not flare or otherwise damage the end of the pipe being driven, nor will the threads at the end of a threaded pipe be damaged by impact forces upon the adaptor. Furthermore, the wedge grip between the pipe, adaptor, and piercing tool, can be easily released by application of impact loading upon the piercing tool in a direction away from the adaptor.

THE DRAWINGS OF PREFERRED EMBODIMENT

FIG. 1 is a plan view of an adaptor of the prior art illustrating flaring of the pipe end, as may happen in a pipe driving operation;

FIG. 2 is a plan view of an adaptor of the prior art illustrating use of an adaptor on a threaded end of a pipe, which could result in thread damage during impact loading of the adaptor;

FIG. 3 is a plan view of an adaptor incorporating the principles of the invention, and illustrating the arrangement when the adaptor is being used to drive a pipe into the ground by a piercing tool;

BRIEF DESCRIPTION OF PRIOR ART

Figure 5:
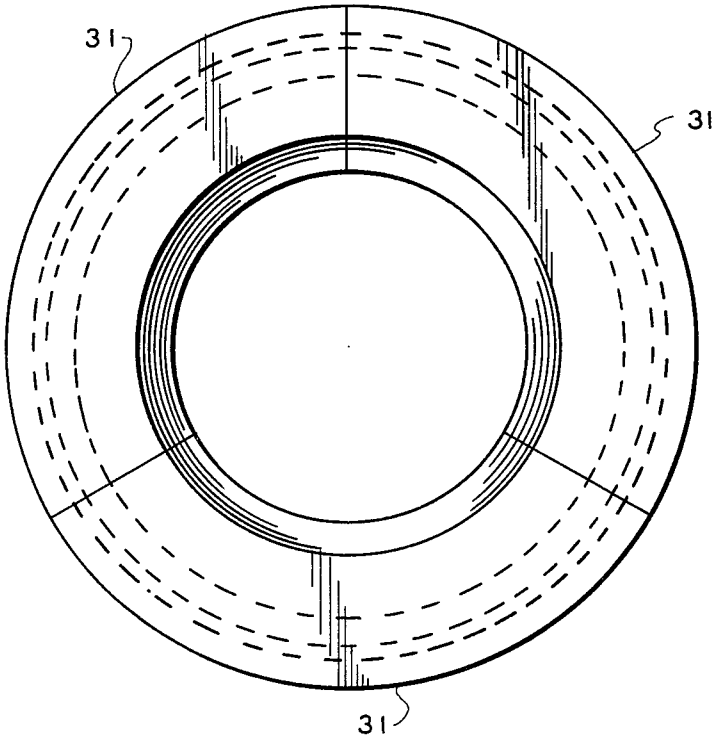
FIG. 5 is a right end view of the same.

Referring now to the drawings, FIG. 1 illustrates a conventional type adaptor 10, being driven by a ground piercing tool 12. The adaptor has a tapered exterior surface which partially enters a pipe 14, being pushed thereby. The adaptor is formed with a tapered axial hole 16 having a slope substantially equal to a slope portion 18 formed on the forward end of the piercing tool 12.

It will be appreciated that the loading on the adaptor by the piercing tool, which is driven by an impacting machine (not shown), will result in a flare 20 made on the pipe end, the dimension of which will bear some relation to the strength of the pipe, and the intensity of the impact forces to which it is being subjected. In any event, such flared portion, which can be left in split or shattered condition, may have to be removed or cut off by a torch, especially if a clean contact joint is desired with an adjoining pipe to be subsequently driven. Furthermore, sometimes the adaptor, pipe and piercing tool are wedged so tightly together, that time consuming effort is required to separate these items.

The disadvantages associated with the conventional type adaptor above-described, should be self-evident.

Referring now to the drawings, FIG. 2 illustrates another conventional type adaptor 22 being driven by the ground piercing tool 12. The pipe 24, being driven by adaptor 22, has a threaded end 26, and the adaptor is designed to make a threaded connection therewith, as clearly illustrated in the drawing. In other respects, the adaptor 22 is similar in design to the adaptor 10.

In this type of pipe driving arrangement, the impact load delivered by the piercing tool 12, can wear down, or otherwise damage the threaded end 26 of the pipe, thus reduce or destroy the effectiveness of a joint formed with another pipe. Furthermore, the distorted threaded connection between the adaptor 22 and the pipe 24, caused by severe impact loading, may result in severe binding which makes uncoupling of the adaptor from the pipe difficult, if at all possible without breakage of the adaptor and/or of the pipe.

The disadvantages associated with the conventional adaptor for use on threaded pipes, as above described, should also be self-evident.

DESCRIPTION OF PREFERRED EMBODIMENT

Figure 4:
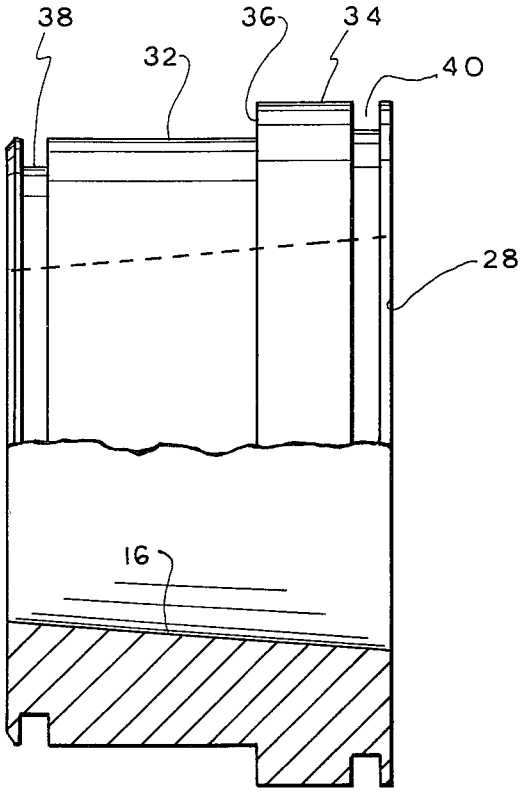
FIG. 4 is a plan view in partial section of an adaptor as illustrated in FIG. 3.

Referring now to FIGS. 3 to 5, an adaptor 28, embodying the principles of the invention is shown in position for driving a pipe 30, as the result of impacts on the adaptor made by the piercing tool 12, hereinbefore described. As best seen in FIG. 5, the adaptor 28 is split into three equal segments 31, which allows for radial expansion of the segments relative to each other.

The adaptor 28 is cylindrical, and has a minor diameter portion 32, and a major diameter portion 34, thereby providing a pipe contacting circumferential shoulder 36 therebetween. Circumferential grooves 38 and 40 are formed in diameter portions 32 and 34 respectively. The grooves each serve to receive garter springs 42 and 44, which are conical springs secured at each end to form a ring. The garter springs serve to maintain the adaptor segments in assembled condition, and also to assist in returning the adaptor to non-operative condition, i.e., condition prior to placement on the end of the piercing tool and in contact with the pipe to be driven.

It will be seen that when the adaptor 28 is placed in the pipe 30, and the piercing tool 12 inserted into the adaptor as shown in FIG. 4, impacting action of the piercing tool will force the taper engagement between the adaptor and apiercing tool to expand the adaptor so that the minor diameter portion 32 will be forced into engagement with the inner surface of the pipe 30. Further percussive blows of the piercing tool forces it to wedge in the adaptor thus making a solid coupling between the pipe, adaptor and piercing tool. The percussive energy of the impacting piercing tool is delivered to the end of the pipe via the adaptor shoulder 36, and the pipe is moved forward in the ground. It will be appreciated that the large area of contact between the adaptor and pipe, will avoid flare or bulge of the pipe.

While FIG. 4 illustrates use of the adaptor on a regular pipe, it will be evident that it can be used with equal effect on a pipe having a thereaded end, without damage to the pipe threads.

When a pipe pushing operation is completed, all that is required is to reverse direction of percussive action of the piercing tool, to release contact with the adaptor. The adaptor is then collapsed under action of the garter springs 42 and 44, and is then readily removable from the pipe. Any ground material, i.e., sand, etc., which enters the pipe as it is pushed by the adaptor, can be easily flushed out.

From the foregoing it will be seen that the subject invention represents a definite and unobvious improvement in the art to which it pertains.

What is claimed is:

1. An adaptor for use is underground pipe pushing, said adaptor comprising a cylindrical body which is axially split to form congruent portions, said body being formed with a tapered axial hole, a shoulder disposed about the periphery of the body, and at least one elastic member surrounding the body for maintaining the portions in assembled condition.

2. An adaptor according to claim 1, wherein said congruent portions total at least three in number.

3. An adaptor according to claim 2, wherein the slope of said tapered axial hole is comparable with the slope of the forward end of a ground piercing tool used with the adaptor.

4. An adaptor according to claim 3, wherein the adaptor has a first portion with a diameter slightly less than the internal diameter of a pipe to be pushed by the adaptor, and a second portion with a diameter at least equal to the external diameter of said pipe.

5. An adaptor according to claim 4, wherein said shoulder is defined by a wall created by the difference in diameters between the first and second portions of the adaptor.

6. An adaptor according to claim 5, wherein a first elastic member is positioned in a circumferential groove formed in the first portion of the adaptor, and a second elastic member is positioned in a circumferential groove formed in the second portion of the adaptor.

7. An adaptor according to claim 6, wherein said elastic members are of the garter-spring type.

* * * * *